US005311233A

United States Patent [19]

Saotome

[11] Patent Number: 5,311,233

[45] Date of Patent: May 10, 1994

[54] PHOTOSENSITIVE MATERIAL DRYING DEVICE

[75] Inventor: Shigeru Saotome, Kanagawa, Japan

[73] Assignee: Fuji Photo Film Co., Ltd., Kanagawa, Japan

[21] Appl. No.: 953,257

[22] Filed: Sep. 30, 1992

[30] Foreign Application Priority Data

Oct. 1, 1991 [JP] Japan ..... 3-253666

[51] Int. Cl.[5] ..... G03D 7/00; G03D 13/00

[52] U.S. Cl. ..... 354/300; 354/298; 354/299

[58] Field of Search ..... 354/298, 299, 300, 319-324; 219/354, 543, 553; 204/298.36

[56] References Cited

U.S. PATENT DOCUMENTS

| | | | |
|---|---|---|---|
| 3,585,390 | 6/1971 | Ishikawa | 219/354 |
| 4,774,396 | 9/1988 | Salit et al. | 219/553 |
| 5,068,517 | 11/1991 | Tsuyuki et al. | 219/543 |
| 5,088,697 | 2/1992 | Murakami et al. | 204/298.36 X |
| 5,097,605 | 3/1992 | Kashino et al. | 354/300 X |

FOREIGN PATENT DOCUMENTS 1-234849 9/1989 Japan .

*Primary Examiner*—D. Rutledge

*Attorney, Agent, or Firm*—Sughrue, Mion, Zinn, Macpeak & Seas

[57] ABSTRACT

A photosensitive material drying device comprising a plurality of far infrared radiation heaters for heating a film are disposed so as to meet at right angles to a direction in which a film is conveyed. The reflectivity of each reflector disposed along the film conveying direction is set so that the reflectivity of each of longitudinally-extending ends of the film is greater than a longitudinally-extending central portion thereof. Therefore, the amount of reflected heat received by the film is associated with the reflectivity. That is, the amount of heat generated from the far infrared radiation heater at longitudinally-extending ends thereof is lower than that at a longitudinally-extending central portion thereof, whereas the amount of heat radiated over the film via the reflector is set such that the amount of heat at the central portion of the far infrared radiation heater is greater than that at the longitudinally-extending ends thereof. Therefore, the amount of heat received by the film becomes uniform along the transverse direction of the film, thereby making it possible to uniformly dry the film and prevent uneven dryness and gloss from occurring.

2 Claims, 5 Drawing Sheets

PHOTOSENSITIVE MATERIAL DRYING DEVICE

BACKGROUND OF THE INVENTION

1. Field of the Invention

The present invention relates to a photosensitive material drying device suitable for use in an automatic developing machine, for example, for drying a photosensitive material with radiant heat.

2. Description of the Related Art

In an automatic developing machine, photosensitive materials such as a photographic film (hereinafter called a "film"), photographic paper, etc. are subjected to developing, fixing and washing processes while being conveyed by rollers, and thereafter are transferred to a drying unit, where a process for drying the photosensitive materials is carried out.

Let's now take a film automatic developing machine as an example. In general, the drying unit is provided with a drying device, which has a plurality of far infrared radiation heaters disposed therein along the direction normal to a film conveying direction, i.e., along the transverse direction of the film, and a plurality of reflectors disposed on the far infrared radiation heater side opposite the film with the film interposed therebetween.

With this drying device, the radiant heat is directly radiated onto the film from the far infrared radiation heaters as far infrared radiation. In addition, the radiant heat is reflected by the reflectors so as to be indirectly radiated onto the exposed film. Afterwards, the film is heated and efficiently dried in a short time.

As represented by the graph in FIG. 8, a surface temperature t of a far infrared radiation heater is normally low at both ends thereof. Therefore, when the lengthwise dimension L of the far infrared radiation heater is set to a value substantially identical to the transverse dimension W of the film as in a conventional photosensitive material drying device ($L \approx W$) (see FIG. 9), a difference is developed between the amount of heat applied to transversely-extending ends of the film and the amount of heat applied to the central portion thereof.

When a far infrared radiation heater 72 is disposed in facing relationship to a film 74 along the transverse direction of the film 74 as shown in FIG. 9, far infrared radiations (see arrows 76) are radiated onto the film 74 from the far infrared radiation heater 72 in such a manner that the amount of the far infrared radiations at the central portion of the film 74 increases when compared to the transversely-extending ends thereof. Therefore, the amount of heat radiated onto the transversely-extending ends of the film 74 differs from that radiated onto the central portion thereof even if the surface temperature of the far infrared radiation heater 72 is kept constant along the longitudinal direction of the far infrared radiation heater 72. This creates a difference between the surface temperature at each of the transversely-extending ends of the film 74 and that at the central portion thereof.

Thus, when the surface temperatures of the film 74 are inconstant along the transverse direction of the film 74, an uneven dryness and glossiness is developed on the film 74. This causes a serious problem in view of the quality of the film 74.

Therefore, a photosensitive material drying device was proposed in a Japanese prior application filed by the present applicant, wherein the longitudinal dimension L of a far infrared radiation heater was made sufficiently longer than the transverse dimension W of a film and portions at which the surface temperature of the far infrared radiation heater is kept constant as represented by the graph in FIG. 10, were provided in facing relationship to the film along the transverse direction thereof. While this proposal undoubtedly improves the above problem it means an increase in the longitudinal dimension of the far infrared radiation heater. As a result, there is an increase in both the size and the manufacturing cost of the drying device. Thus, there is still room for improvement.

SUMMARY OF THE INVENTION

With the foregoing problems in view, it is an object of the present invention to provide a photosensitive material drying device which is capable of heating and drying an exposed photosensitive material in such a manner that the surface temperature of the photosensitive material is uniform along a direction orthogonal to a photosensitive-material conveying direction. By doing so, a reduction in size and cost can be made.

According to one aspect of the present invention, there is provided a photosensitive material drying device for drying an exposed photosensitive material with heating means disposed in facing relationship to the photosensitive material so as to meet at right angles to a direction in which the photosensitive-material is conveyed and to have substantially the same dimension as the transverse dimension of the photosensitive material, the photosensitive material drying device comprising amount-of-heat boosting means for increasing the amount of heat at longitudinally-extending ends of the heating means.

A reflecting surface of a reflector used as one example of the amount-of-heat boosting means for increasing the amount of heat of the heating means, is formed in such a manner that there are variations in polish on the surfaces of the reflector along the longitudinal direction of the heating means. That is, the reflecting surfaces at both ends of the reflector are smooth whereas the reflecting surface at the central portion thereof is rough. Consequently, the reflectivity of the reflector gradually increases toward the ends of the heating means from the longitudinally-extending central portion of the heating means. Even if the amount of heat radiated directly onto the photosensitive material from the heating means is low at its both ends, the amount of heat radiated indirectly onto the photosensitive material increases toward both ends thereof in accordance with the reflectivity. Therefore, the photosensitive material can be uniformly dried along the transverse direction thereof, thereby making it possible to prevent uneven dryness and gloss from being developed on the photosensitive material. It is also unnecessary to increase the lengthwise dimension of the heating means. Therefore, the photosensitive material drying device can be reduced in size and cost.

The above and other objects, features and advantages of the present invention will become apparent from the following description and the appended claims, taken in conjunction with the accompanying drawings in which preferred embodiments of the present invention are shown by way of illustrative example.

DETAILED DESCRIPTION OF THE PREFERRED EMBODIMENTS

Figure 2:
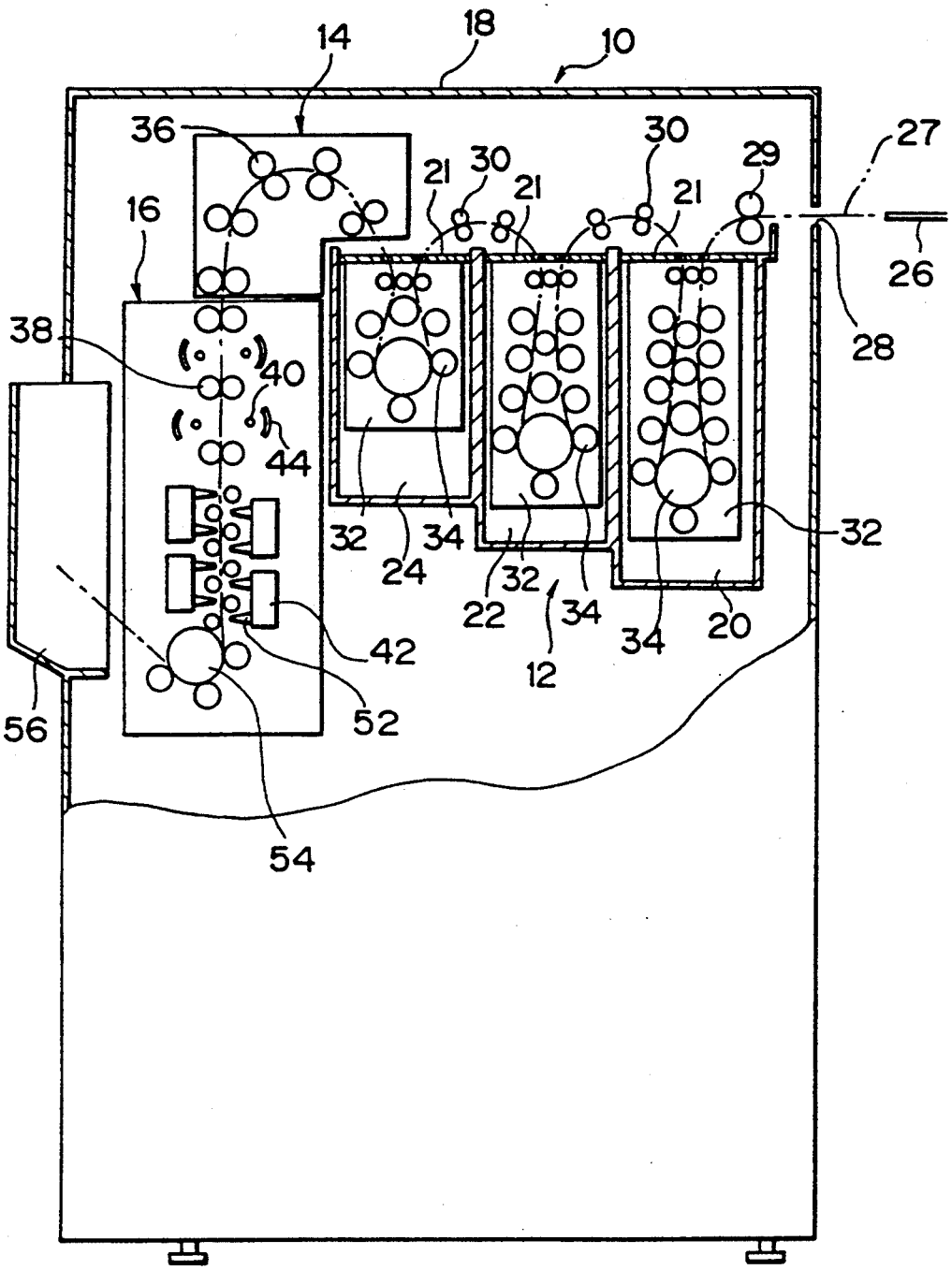
FIG. 2 is a schematic vertical cross-sectional view showing an automatic developing machine provided with the photosensitive material drying device shown in FIG. 1.

FIG. 2 shows an automatic developing machine 10 provided with a photosensitive material drying device according to a first embodiment of the present invention.

The automatic developing machine 10 comprises a processing unit 12, a squeezing unit 14 and a drying unit 16, all of which are accommodated within a housing 18.

The processing unit 12 is disposed in an upper position within the housing 18 and comprises a developing tank 20, a fixing tank 22 and a washing tank 24. As one example of a photosensitive material, a sheet-like X-ray film (hereinafter called a "film 26"), is conveyed along a conveying path 27 indicated by the alternate long and short dash lines in FIG. 2. That is, the film 26 is inserted through a film insertion slot 28 defined in an upper portion of a right side wall of the housing 18, then interposed between a pair of insertion rollers 29 disposed in the vicinity of the film insertion slot 28 and conveyed. Thereafter, the film 26 is successively fed into the developing tank 20, the fixing tank 22 and the washing tank 24 by being conveyed by conveying rollers 30 disposed in upper positions between the respective adjacent tanks and roller groups 34 disposed in the respective tanks and supported by respective conveying racks 32, whereby developing, fixing and washing processes are carried out. A developer, a fixing liquid and a washing liquid serving as processing liquids are circularly supplied to the developing tank 20, the fixing tank 22 and the washing tank 24 respectively. Floating covers 21 each having a pair of apertures for inserting the film 26 therethrough and taking it out therefrom are disposed on their corresponding processing liquids. The floating covers 21 prevent the processing liquids from being in unnecessary contact with air.

Incidentally, an unillustrated auto-feeder for automatically inserting the film 26 into the film insertion slot 28 can be mounted to a position in the vicinity of the film insertion slot 28.

The squeezing unit 14 is adjacently provided on the left side of the washing tank 24. After being subjected to washing in the washing tank 24, the film 26 is interposed between and conveyed by conveying rollers 36. Any water or moisture, which has adhered to the surface of the film 26, is squeezed off during this film conveying process.

The drying unit 16 is disposed on the downstream side of the squeezing unit 14. In the drying unit 16, far infrared radiation heaters 40 serving as heating means dry the film 26 with radiant heat while the film 26 is being conveyed downward by conveying rollers 38.

Figure 1:
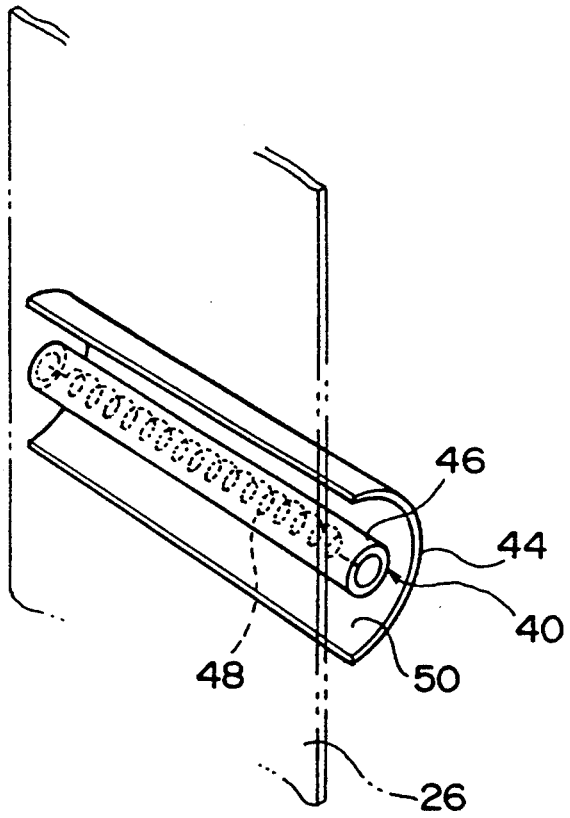
FIG. 1 is a perspective view showing a photosensitive material drying device according to a first embodiment of the present invention.
Figure 3:
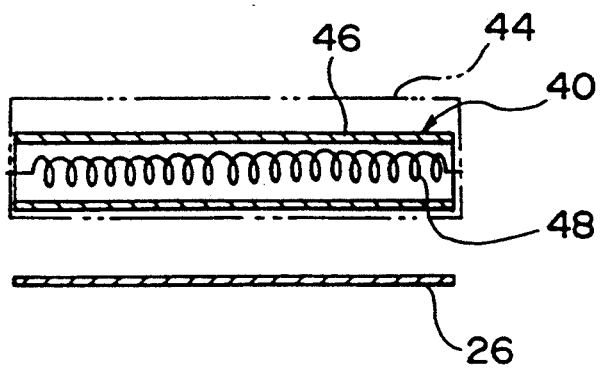
FIG. 3 is a transverse cross-sectional view illustrating the photosensitive material drying device shown in FIG. 1.

Two pairs of far infrared radiation heaters 40 are provided in upper and lower positions and in a facing relationship to both sides of the film 26 so that the film 26 is conveyed therebetween. As shown in FIGS. 1 and 3, each of the far infrared radiation heaters 40 is constructed such that a coiled nichrome wire 48 serving as a heat source is accommodated in a cylindrical ceramic tube 46. The radiant heat serving as the far infrared radiation is radiated over the film 26 by applying a desired voltage to the nichrome wire 48. The far infrared radiation heaters 40 are disposed in confronting relationship so as to meet at right angles to the direction in which the film 26 is conveyed. That is, the longitudinal direction of each of the far infrared radiation heaters 40 represents the transverse direction of the film 26, whereas the lengthwise dimension of each of the far infrared radiation heaters 40 is substantially identical to the transverse dimension of the film 26.

Respective pairs of reflectors 44 are disposed on the far infrared radiation heater 40 side opposite the film 26 as amount-of-heat boosting or increasing means. As shown in FIG. 1, the reflector 44 is shaped in the form of an arcuate semi-cylinder having the center of curvature on the far infrared radiation heater 40 side. In addition, the reflector 44 reflects far infrared radiation radiated from the far infrared radiation heater 40 toward the reflector 44, which reflects the far infrared radiation toward the film 26 to thereby cause the far infrared radiation emitted from the far infrared radiation heater 40 to efficiently reach the film 26.

A reflecting surface 50 of the reflector 44 has variations (not shown) in polish, which are given from a longitudinally-extending central portion of the reflector 44 to both ends thereof. That is, the reflecting surface 50 has been smoothly finished at both ends of the reflector 44 whereas it has been roughly finished at the central portion thereof. Therefore, the reflectivity r of the reflector 44 gradually increases from the longitudinally-extending central portion thereof to both ends thereof as represented by a graph in FIG. 4.

Thus, the quantity of heat to be reflected increases at the longitudinally-extending ends of the far infrared radiation heater 40 in accordance with high reflectivity r of the reflector 44.

The drying unit 16 has a plurality of hot-air suppliers 42 disposed below the pairs of far infrared radiation heaters 40. As seen in FIG. 2, two pairs of hot-air suppliers 42 are provided in upper and lower positions and in confronting relationship with respect to both sides of the film 26 so that the film 26 is conveyed therebetween. Each of the hot-air suppliers 42 is formed with a pair of blow nozzles 52 from which hot air blows against the film 26. Thus, the film 26 is changed from a constant-drying-rate condition (drying condition where heat applied to the film 26 with moisture left on the surface thereof is used as the latent heat of vaporization) to a falling-drying-rate condition (drying condition where moisture left on the surface of the film 26 is reduced by evaporation). Afterwards, the film 26 is subjected to a gentle hot-air drying process at a low temperature.

Then, the film 26, which has been subjected to the drying process, is reversed and moved in an oblique upward direction by a guide roller 54 so as to be received in a film receiving case 56 formed in a central portion of a left side wall of the housing 18.

The operation of the present embodiment will now be described below.

The film 26 is first inserted in the housing 18 through the film insertion slot 28 and then subjected to the developing, fixing and washing processes in the processing unit 12.

Afterwards, the film 26 thus processed is squeezed in the squeezing unit 14 and delivered to the drying unit 16.

In the drying unit 16, the processed film 26 is subjected to radiant-heat drying by each of the far infrared radiation heaters 40.

Figure 4:
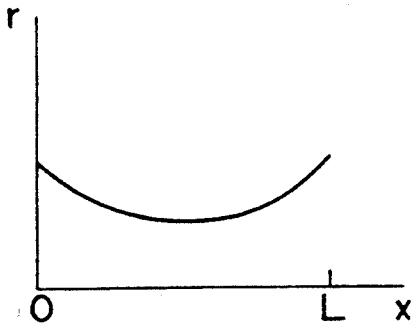
FIG. 4 is a graph illustrating the distribution of reflectivity of a reflector employed in the photosensitive material drying device shown in FIG. 1.
Figure 5:
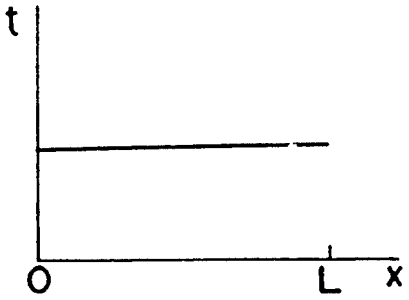
FIG. 5 is a graph illustrating the distribution of a film surface temperature obtained from the photosensitive material drying device shown in FIG. 1.
Figure 8:
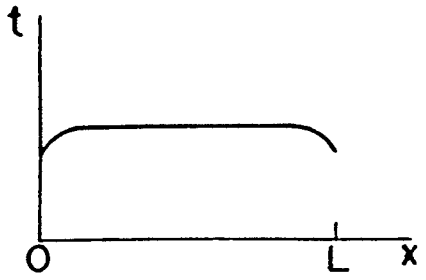
FIG. 8 is a graph illustrating the distribution of a surface temperature of a far infrared radiation heater employed in a conventional photosensitive material drying device.
Figure 9:
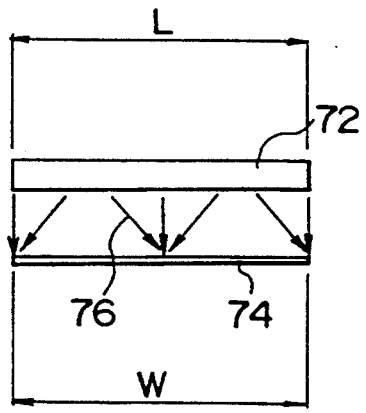
FIG. 9 is a view for describing far infrared radiations which extend from a far infrared radiation heater of a photosensitive material drying device according to the present invention onto a film.
Figure 10:
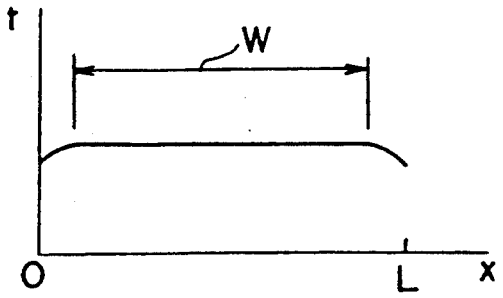
FIG. 10 is a graph illustrating the distribution of a surface temperature of a far infrared radiation heater of an improved conventional photosensitive material drying device.

The amount of heat to be reflected onto the film 26 in the drying unit 16 corresponds to the reflectivity r (as shown in FIG. 4) of the reflecting surface 50 (see FIG. 1) of the reflector 44. That is, the quantity of heat of the far infrared radiation heater 40 at the longitudinally-extending ends thereof is lower than that at the central portion thereof (see FIG. 8). Conversely the amount of heat radiated over the film 26 via the reflector 44 is set such that the amount of heat at both ends thereof is greater than that at the central portion thereof. Therefore, the amount of heat radiated to the film 26 becomes uniform along the transverse direction of the film 26 as shown in FIG. 5, thereby making it possible to uniformly dry the film 26 and prevent uneven dryness and glossiness from occurring. It is also unnecessary to make the lengthwise dimension of the far infrared radiation heater 40 longer. Therefore, the photosensitive material drying device can be reduced in size and manufacturing cost.

In the first embodiment, the reflectivity of the reflector 44 has been changed by making variations in polish on the reflecting surface 50 of the reflector 44. As an alternative, however, the difference in the amount of radiant heat generated from the respective far infrared radiation heaters 40 to be reflected onto the film 26 may be made by changing the shape of the reflector 44 or by varying the curvature of the reflector 44.

Finally, the film 26 is dried by hot air supplied from the hot-air suppliers 42, after which it is discharged into the film receiving case 56.

Second and third embodiments will now be described below with reference to FIGS. 6 and 7 respectively.

Figure 6:
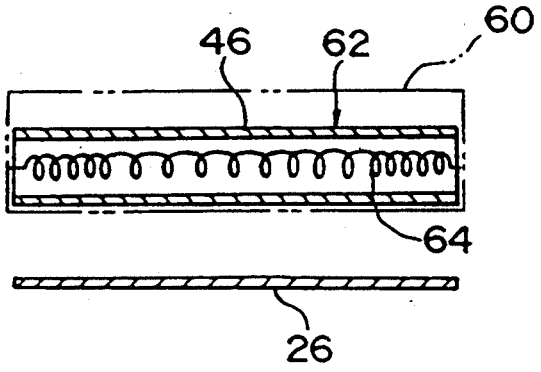
FIG. 6 is a transverse cross-sectional view showing a photosensitive material drying device according to a second embodiment of the present invention.

In the second embodiment, the reflectivity of a reflector 60 is kept constant and the amount of winding of a nichrome wire 64 at both ends of a far infrared radiation heater 62 is denser than that at a longitudinally-extending central portion thereof as shown in FIG. 6.

Figure 7:
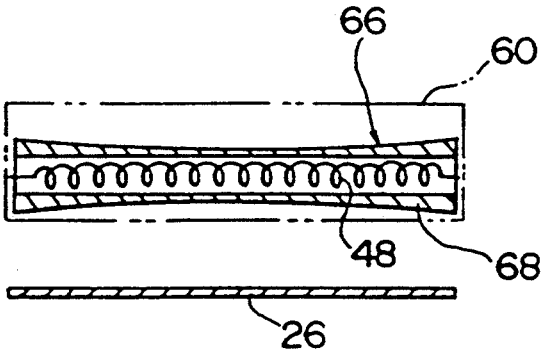
FIG. 7 is a transverse cross-sectional view depicting a photosensitive material drying device according to a third embodiment of the present invention.

In the third embodiment, the thickness of a ceramic tube 68 in which a nichrome wire 48 serving as a heat source is held, is such that a longitudinally-extending central portion of a far infrared radiation heater 66 is thinner than longitudinally-extending ends thereof as illustrated in FIG. 7.

According to the second and third embodiments, the amount of heat radiated over the film 26 is kept uniform along the transverse direction of the film 26 in a manner similar to the first embodiment even if the lengthwise dimensions of the far infrared radiation heaters 62, 66 are identical to the lateral dimension of the film 26.

Thus, even in the second and third embodiments, the surface temperature of the film 26 can be uniformly obtained along the transverse direction thereof.

The present invention has shown a process for drying an X-ray film as an illustrative example. However, the present invention is not necessarily limited to the above-described embodiments. It is needless to say that various changes can be made. The above-described respective embodiments have shown a case in which the drying device is disposed in the drying unit 16, for example. However, the present invention is not necessarily limited to this case. The drying device may also be disposed in the squeezing unit 14. As a result, a further reduction in the drying time of the film in the drying unit 16 can be made. Further, far infrared radiation heaters have been used as heating means in the above-described embodiments. However, infrared radiation heaters other than the far-type and other heaters may be used. Alternatively, a heater, which can heat photosensitive materials by its radiant heat, may also be available.

Having now fully described the invention, it will be apparent to those skilled in the art that many changes and modifications can be made without departing from the spirit or scope of the invention as set forth herein.

What is claimed is:

1. A photosensitive material drying device for drying an exposed photosensitive material, said photosensitive material drying device comprising:

far infrared radiation heater means disposed in facing relationship to said photosensitive material so as to be perpendicular to a conveyance direction of said photosensitive material and having substantially a same longitudinal dimension as a transverse dimension of said photosensitive material;

said far infrared radiation heater means including a heat source inserted into a ceramic tube, said ceramic tube having first and second ends and said ceramic tube being formed such that a longitudinally-extending central portion thereof has a thickness less than that of portions extending from said central portion of said ceramic tube to said first and second ends thereof, wherein said thickness varies in a direction transverse to said conveyance direction of said photosensitive material.

2. A photosensitive material drying device according to claim 1, further comprising a reflector having first and second ends and having a reflecting surface for reflecting heat generated by said heating means toward the photosensitive material, wherein a reflectivity of said reflecting surface of said reflector increases from a longitudinally-extending central portion of said reflector to said first and second ends of said reflector, such that said reflectivity varies in a direction transverse to said conveyance direction of said photosensitive material.

* * * * *